US005504399A

United States Patent [19]

Tobler

[11] Patent Number: 5,504,399

[45] Date of Patent: Apr. 2, 1996

[54] ELECTRICAL CIRCUIT FOR OPERATING A FLUORESCENT LAMP AND FOR MEASURING THE LAMP CURRENT

[75] Inventor: Felix Tobler, Schanis, Switzerland

[73] Assignee: Knobel AG Lichttechnische Komponenten, Ennenda, Switzerland

[21] Appl. No.: 125,167

[22] Filed: Sep. 23, 1993

[30] Foreign Application Priority Data

Sep. 24, 1992 [EP] European Pat. Off. ..... 92116334

[51] Int. Cl.[6] ..... H05B 41/16

[52] U.S. Cl. ..... 315/278; 315/239; 315/244; 315/226; 315/291; 315/94; 315/DIG. 2

[58] Field of Search ..... 315/94, 98, 99, 315/101, 103, 106, 239, 244, 278, 209 R, 205, 200 R, 226, 291, DIG. 2, DIG. 5, DIG. 7

[56] References Cited

U.S. PATENT DOCUMENTS

| | | | |
|---|---|---|---|
| 4,017,761 | 4/1977 | Woldring | 315/99 |
| 4,399,391 | 8/1983 | Hammer et al. | 315/244 |
| 4,553,071 | 11/1985 | Boyd | 315/244 |
| 4,959,591 | 9/1990 | Hirschmann | 315/209 R |
| 4,988,920 | 1/1991 | Hoeksma | 315/101 |
| 5,192,896 | 3/1993 | Qin | 315/224 |

FOREIGN PATENT DOCUMENTS

| | | |
|---|---|---|
| 0490330 | 6/1992 | European Pat. Off. . |
| 3709004 | 9/1988 | Germany . |

*Primary Examiner*—Robert J. Pascal
*Assistant Examiner*—Haissa Philogene
*Attorney, Agent, or Firm*—Greenblum & Bernstein

[57] ABSTRACT

In an electrical circuit for feeding a fluorescent lamp, a serial resonant circuit is comprised of a first coil of a feedback-transformer, a resonant inductor, a coupling condenser, a first lamp cathode, a resonant condenser, and a first coil of an isolating transformer, this serial resonant circuit being connected between the output of an inverted rectifier, connected to a voltage supply source and one terminal of said voltage supply source, with a second coil of the isolating transformer being connected in parallel with the second lamp cathode. If the coils of the isolating transformer have the same number of loops, this connection of the second lamp cathode ensures that the same heating current will flow through both lamp cathodes, so that these will be heated equally. The parallel circuit of the second lamp cathode with the second coil of the isolating transformer is connected through a resistance with a terminal of the supply voltage. The lamp current flows through this resistor, thus the voltage across the resistor is proportional to the actual current of the lamp and it can therefore be transmitted to the main circuit which regulates the lamp current.

15 Claims, 5 Drawing Sheets

ELECTRICAL CIRCUIT FOR OPERATING A FLUORESCENT LAMP AND FOR MEASURING THE LAMP CURRENT

CROSS REFERENCE TO RELATED APPLICATIONS

This application claims the priority of European Patent Application No. EP 92 116 334.1, filed Sep. 24, 1992, the disclosure of which is incorporated herein by reference in its entirety.

BACKGROUND OF THE INVENTION

1. Field of the Invention

This invention pertains to an electrical circuit arrangement wherein an inverted rectifier is connected to a voltage source, with a resonant circuit, for operating at least one fluorescent lamp, together with means for measuring the lamp current.

2. Discussion of the Background of the Invention and Material Information

German Patent Publication DE 37 09 004 C2 discloses a circuit which controls the brightness of a fluorescent lamp through the measure and the regulation of the lamp current. The lamp current is measured through a differential current meter and its actual value is transmitted to a regulating element in order to maintain the lamp current at a predetermined rated value. If the lamp current is to be regulated within a large dynamic range, then the coils of the differential current meter must be manufactured very precisely, which is detrimental relative to the manufacturing costs of this electrical circuit arrangement.

SUMMARY OF THE INVENTION

The present invention overcomes the noted disadvantage of the prior art and has the general object to provide an electrical circuit with an inverted rectifier connected to a voltage supply source, with a resonant circuit, for operating at least one fluorescent lamp and with means for measuring the lamp current, which circuit is not only less expensive than known circuits, but which also allows measuring of the lamp current throughout a wide dynamic range.

This general object is achieved by an electrical circuit of the noted type, in which the resonant circuit, which comprises one of the cathodes of the lamp, is connected between the output of the inverted rectifier and one terminal of the voltage supply source, the second cathode of the lamp being coupled to the resonant circuit through an isolating transformer, with the means for measuring the lamp current being located between the second cathode of the lamp and the voltage source.

Specifically, an electrical circuit with an inverted rectifier is connected to a voltage source, having a resonant circuit for operating at least one fluorescent lamp, and having means for measuring the lamp current, wherein the resonant circuit, which comprises a first one of the cathodes of the lamp is connected between the output of the inverted rectifier and one terminal of a voltage supply source, with a second cathode of the lamp being coupled to the resonant circuit through an isolating transformer, with said means for measuring the lamp current being located between the second cathode of the lamp and the voltage supply source.

In one embodiment of this invention, the resonant circuit is a serial resonant circuit having a coupling condenser, a resonant condenser, a resonant inductor and a first coil of a feed-back transformer, with a first coil of the isolating transformer being connected in series in the serial resonant circuit, a second coil of the isolating transformer being connected in parallel to the second cathode of the lamp.

The means for measuring the lamp current preferable comprises a measuring resistance. The means for measuring the lamp current can also comprise a serial arrangement which encompasses a measuring resistance and a first diode, connected in series, with a second diode being connected in parallel to said serial arrangement in a manner so that a first half-phase of said lamp current flows through said serial arrangement and a second half-phase of the lamp current flows through the second diode.

Another embodiment of this invention includes a measuring circuit for the voltage of the lamp cathode, which circuit is connected in parallel with a first coil of the isolating transformer. In addition, a resistance, connected in series with the first coil of the isolating transformer, measures the heating current of the cathode.

A further embodiment of this invention includes a third coil of the isolating transformer, this third coil being connected in parallel to the first lamp cathode, by a switch connected in parallel to the first coil of the isolating transformer, and by a command circuit for actuating the switch. Preferably, this switch comprises a semi-conductor element and the command circuit reacts to a threshold of the voltage of the lamp cathode or to a threshold of the heating current of the cathode.

Yet another embodiment of this invention operates a serial arrangement of at least two fluorescent lamps, wherein each set of neighboring lamp cathodes of the fluorescent lamps is connected in series, and each such serial set is connected in parallel with a second coil of a corresponding additional isolating transformer, with the corresponding first coil of the isolating transformer being connected in series with the resonant circuit.

Finally, a switching means is utilized for the selection of a predetermined lamp current, with that switching means influencing the rated or the actual value of the lamp current.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

Figure 1:
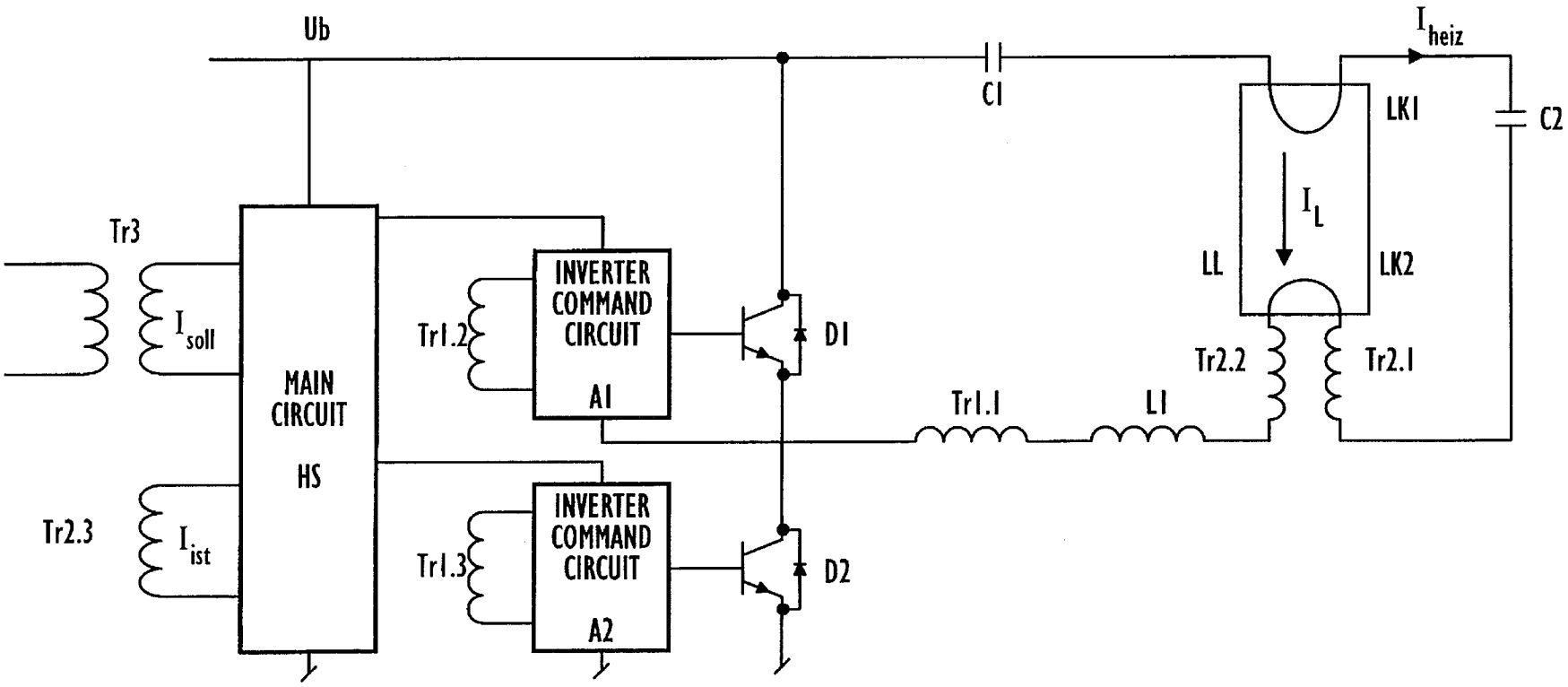
FIG. 1 PRIOR ART
FIG. 1 is a schematic representation of a known prior art circuit for operating a fluorescent lamp.

The prior art circuit represented in FIG. 1 comprises a fluorescent lamp LL which, together with lamp cathodes LK1, LK2, a coupling condenser C1, a resonant condenser C2, two coils of the differential current transformer TR2.1, TR2.2, a resonant inductance L1 and a coil of a feedback transformer Tr1.1, forms a serial resonant circuit which is connected between the terminal of a voltage supply source Ub and the output of an inverter that operates on the supply voltage.

In the present embodiment, the inverter consists of two power transistors which switch, through two command circuits A1, A2 and two coils of the feedback transformer TR1.2, TR1.3, one terminal of the serial resonant circuit being between the terminals of the voltage supply source Ub, with a frequency proximate to the resonant frequency of the serial resonant circuit.

Different operating modes of the fluorescent lamps, such as the preheating of the lamp cathodes, the firing, the normal mode and the dim mode, are obtained by shifting the switching frequency of the inverter with respect to the inherent frequency of the resonant circuit. A main circuit HS ensures a proper sequence of the supply for the fluorescent lamp after the circuit has started operating. First, the cathodes of the lamp are preheated, then the fluorescent lamp is fired up, and the lamp current is regulated to a predetermined rated value $I_{so11}$. The actual value $I_{ist}$ of the lamp current is transmitted to main circuit HS through a third coil Tr2.3 of the differential current transformer. The rated value $I_{so11}$ of the lamp current is transmitted to main circuit HS through a rated value transmitter Tr3.

When the fluorescent lamp LL operates in a strongly dimmed state, for instance when it must be operated at 1% of the rated lamp current, the cathodes of the lamp must be heated at all times in order to avoid premature aging of the fluorescent lamp. The heating of the cathodes LK1, LK2 of the lamp is obtained by the cathode heating current $I_{heiz}$, which flows through the resonant condenser C2 and which is notably larger than the lamp current $I_L$ when the lamp is strongly dimmed. When the total current of a differential current transformer is much larger than the differential current, the precision of the first two coils Tr2.1, Tr2.2 of the differential current transformer must be very exact in order to ensure that the differential current transformer works without error throughout a large dynamic interval.

Figure 2:
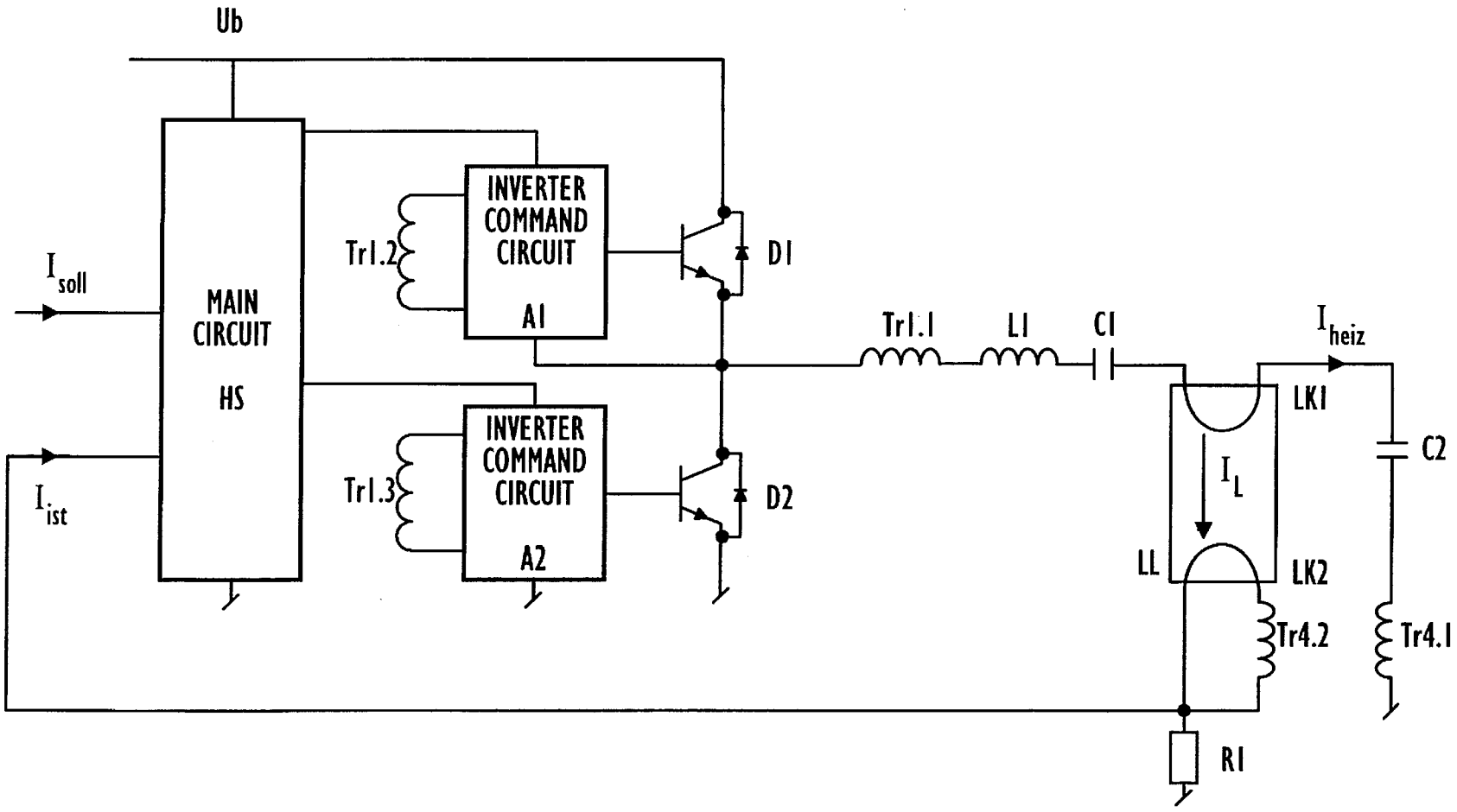
FIG. 2 is a schematic representation of a first embodiment of the invention.

Turning now to the present invention, FIG. 2 schematically shows an embodiment of the circuit wherein the serial resonant circuit consists of a first coil of a feedback transformer Tr1.1, a resonant inductance L1, a resonant condenser C2 and a first coil of an isolating transformer Tr4.1. This serial resonant circuit is connected between the output of an inverter which operates on the supply voltage Ub, and a terminal of the supply voltage Ub.

The second coil of the isolating transformer Tr4.2 is connected in parallel with the second lamp cathode LK2. When this circuitry is used in connection with the second lamp cathode LK2, given that the coils of the isolating transformer Tr4.1, Tr4.2 have the same number of loops, the same currents $I_{heiz}$ will flow through the two lamp cathodes LK1, LK2, thus achieving that these two lamp cathodes are heated equally.

The parallel circuit, consisting of this second lamp cathode LK2 and the second coil of the isolating transformer Tr4.2, is connected to a potential through a resistance R1 which is connected to a terminal of the supply voltage Ub. The lamp current $I_L$ flows through the resistance R1. The voltage which arises across the resistance R1 is thus proportional to the actual value of the lamp current $I_{ist}$, and can therefore be transmitted to the main circuit HS, which is also provided for regulating the lamp current. A person skilled in this art will realize that such a solution for measuring the lamp current is notably less expensive than measurement with a differential current transformer.

Figure 3:
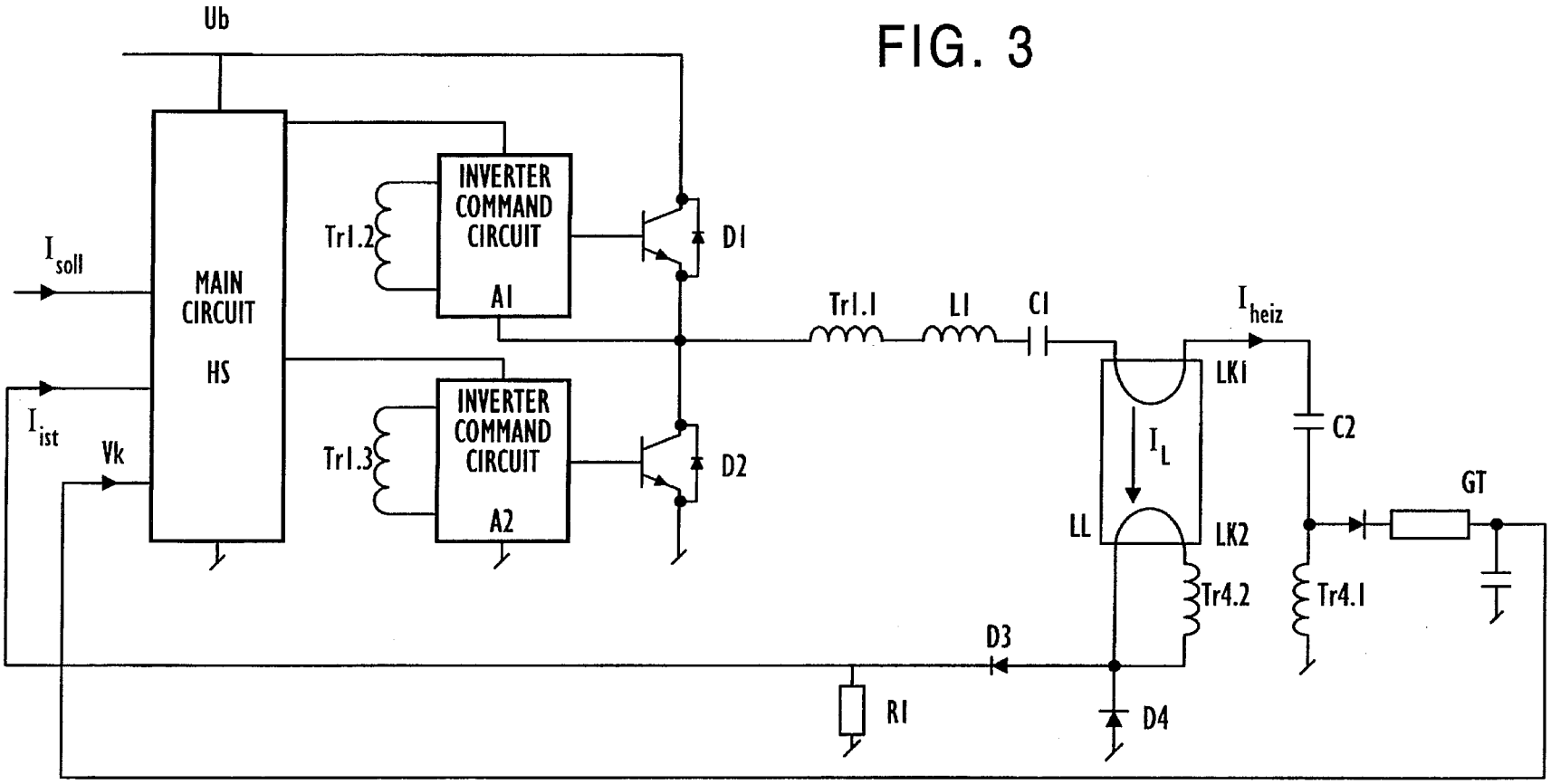
FIG. 3 represents another embodiment of the circuit arrangement according to the invention, which implements a half-wave rectification of the lamp current and the measuring of the cathode voltage.

FIG. 3 shows a further embodiment of the circuit according to the invention. Compared to the circuit of FIG. 2, the lamp current here is transmitted during one half-wave through a serial circuit with a first diode D3 and a resistance R1, and during the other half-wave through a second diode D4. It is thus possible to transmit to the main circuit HS a value of the lamp current which is already rectified. Another possibility consists in transmitting the value of the cathode Vk of the lamp to the main circuit with the help of a simple rectifier-low-pass unit GT. The voltage Vk of the cathode of the lamp corresponds to an information about the state of the lamp cathodes during preheating, during normal mode, or during the dim mode of the fluorescent lamp. Like the preheating current, the lamp current and the cathode heating current, the lamp cathode voltage Vk is an important parameter which according to the service instructions of the manufacturers of the lamps must be maintained within certain limits in order not to impair the life-span of such fluorescent lamps.

Figure 4:
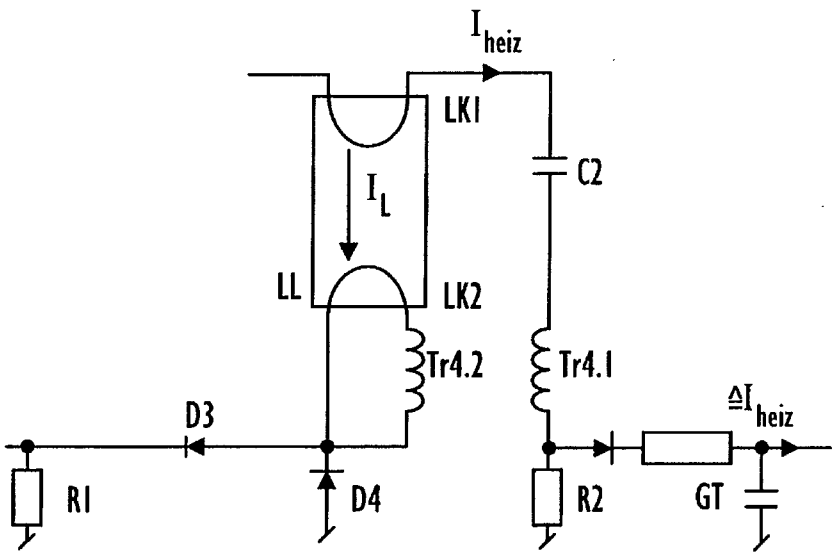
FIG. 4 represents a further embodiment of the circuit according to the invention which implements the measuring of the heating current of the cathode.

FIG. 4 is a partial representation of another embodiment of the circuit according to the invention, where the cathode heating current $I_{heiz}$ can be monitored with the help of a resistor R2 which is connected in series with the first coil of the isolating transformer Tr4.1, and of a simple rectifier-low-pass unit GT. The determination of the cathode heating current can be used during preheating for an optimal regulation of the preheating current for the lamp cathodes. This determination can also be used during the firing mode for a measurement of the amplitude of the firing voltage (given a known oscillating frequency and a known value of the resonant condenser C2), and during the lamp or dimmed mode it can be used to monitor the maximal cathode heating current.

Figure 5:
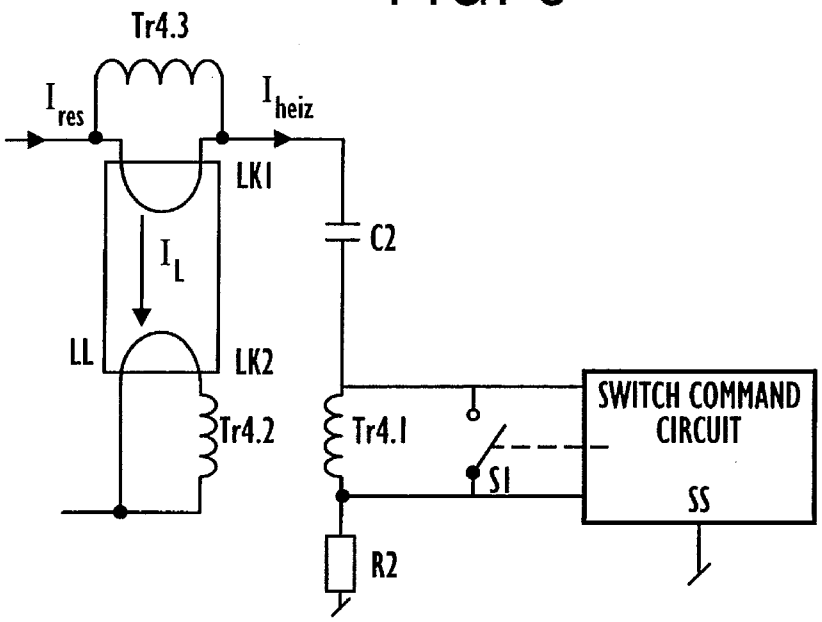
FIG. 5 is yet another embodiment of the circuit according to the invention, which embodies a circuit for regulating the heating of the cathode.

FIG. 5 is a partial representation of a further embodiment of the invention, where it is possible to regulate the heating power in the lamp cathodes LK1, LK2 with the help of a third coil of the isolating transformer Tr4.3. The latter is connected in parallel to the first lamp cathode LK1, and with a switch S1, commanded by a command circuit SS, which is connected in parallel to the first coil of the isolating transformer Tr4.1. Depending on the lamp cathode voltage applied to the switch S1, this switch may, for instance, be periodically closed when a predetermined threshold value is reached, and thus suppress a further heating of the lamp cathode during the corresponding half-period.

This periodic closing allows minimization of the power loss of the circuit arrangement, and to easily satisfy the corresponding service instructions of the lamp manufacturers. Switch S1 can also be commanded through a threshold value of the cathode heating current $I_{heiz}$, or the commands can occur periodically so that the heating of the lamp cathodes LK1, LK2 occurs independently of the magnitude of total resonant current of the serial resonant circuit $I_{res}$ and of its frequency.

Figure 6:
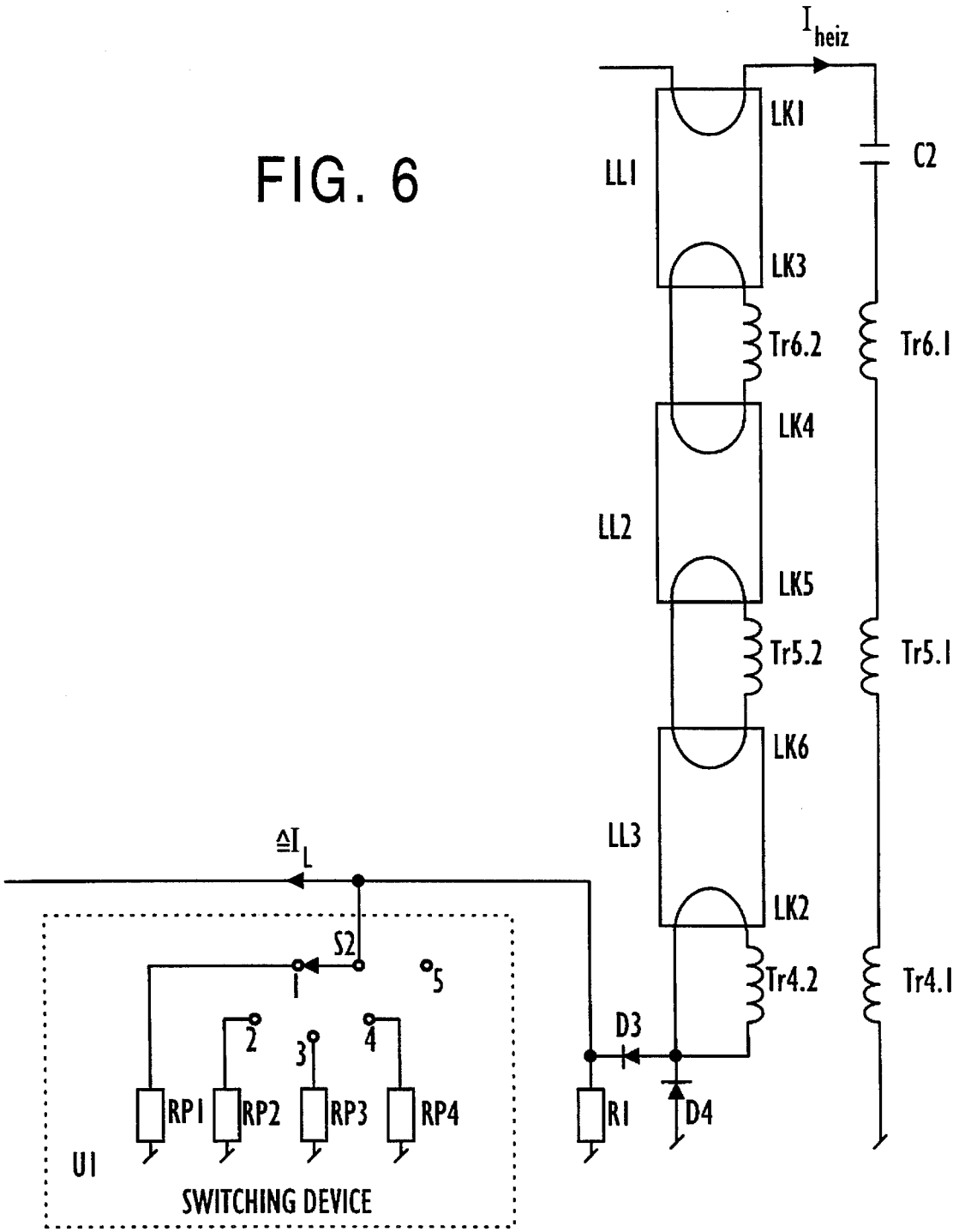
FIG. 6 is yet a further embodiment of the circuit according to the invention, which operates several fluorescent lamps and comprises switching means for the adaptation to particular types of fluorescent lamps.

FIG. 6 is a partial representation of an embodiment of the circuit according to the invention, which includes several fluorescent lamps LL1, LL2, LL3. In this embodiment each pair of neighboring lamp cathodes LK3, LK4, LK5, and LK6 is connected in series, and each such serial pair is connected in parallel with a second coil of a corresponding additional isolating transformer Tr5.2, Tr6.2. At the same time, the corresponding first coil of each of isolating transformers Tr5.1, Tr6.1 is connected in series with the resonant circuit. If the first and second coil of the isolating transformers have the same number of loops, all lamp cathode currents will be equal to the cathode heating current $I_{heiz}$, and all lamp cathodes will be heated uniformly.

A switching device U1 can be used in order to make the same circuitry switchable between different types of lamps having different lamp power and different lamp currents. In this instance, one can for example adapt the circuitry to different types of lamps by adding different parallel resistors RP1, RP2, RP3, and RP4 to measuring resistor R1, so that each fluorescent lamp is given an adequate lamp current. Such a switching device can be provided in the circuit which predetermines the rated value, instead of being provided in the measuring circuit for the lamp current.

While there are shown and described present preferred embodiments of the invention, it is to be distinctly understood that the invention is not limited thereto, but may be otherwise variously embodied and practiced within the scope of the following claims and the reasonably equivalent structures thereto.

What is claimed is:

1. An electrical circuit with an inverted rectifier connected to a voltage source, having a resonant circuit for operating at least one fluorescent lamp, and having means for measuring the lamp current, wherein said resonant circuit, which comprises a first one of the cathodes of said at least one lamp and a first coil of an isolating transformer, is connected between the output of said inverted rectifier and one terminal of a voltage supply source, with a second cathode of said at least one lamp being coupled to the resonant circuit through a second coil of said isolating transformer, wherein said second coil is connected in parallel to said second cathode, with said means for measuring the lamp current being means separate from said isolating transformer and being located between said second cathode of said at least one lamp and said voltage supply source.

2. The electrical circuit of claim 1,wherein said resonant circuit is a serial resonant circuit having a coupling condenser, a resonant condenser, a resonant inductor and a first coil of a feed-back transformer, with a first coil of said isolating transformer being connected in series in the serial resonant circuit.

3. The electrical circuit of claim 1, wherein said means for measuring said lamp current comprises a measuring resistance.

4. The electrical circuit of claim 2, wherein said means for measuring said lamp current comprises a measuring resistance.

5. The electrical circuit of claim 1, wherein said means for measuring the lamp current comprises a serial arrangement which encompasses a measuring resistance and a first diode, connected in series, and wherein a second diode is connected in parallel to said serial arrangement in a manner so that a first half-phase of said lamp current flows through said serial arrangement and a second half-phase of said lamp current flows through said second diode.

6. The electrical circuit of claim 2, wherein said means for measuring the lamp current comprises a serial arrangement which encompasses a measuring resistance and a first diode, connected in series, wherein a second diode is connected in parallel to said serial arrangement in a manner so that a first half-phase of said lamp current flows through said serial arrangement and a second half-phase of said lamp current flows through said second diode.

7. The electrical circuit of claim 1, including a measuring circuit for the voltage of one of said lamp cathodes, said measuring circuit being connected in parallel with a first coil of said isolating transformer.

8. The electrical circuit of claim 1, including a resistance connected in series with a first coil of said isolating transformer for measuring the heating current of one of said cathodes.

9. The electrical circuit of claim 1, including a third coil of said isolating transformer, said third coil being connected, in parallel to said first one of said lamp cathodes, by a switch being connected in parallel to a first coil of said isolating transformer, and by a command circuit for actuating said switch.

10. The electrical circuit of claim 9, wherein said switch comprises a semi-conductor element and said command circuit reacts to a threshold of the voltage of one of said cathodes.

11. The electrical circuit of claim 9, wherein said switch comprises a semi-conductor element and said command circuit reacts to a threshold of the heating current of at least one of said cathodes.

12. The electrical circuit according to claim 1, for operating a serial arrangement of at least two fluorescent lamps, wherein each set of neighboring lamp cathodes of said fluorescent lamps is connected in series as a serial set, with each such serial set being connected in parallel with a second coil of a corresponding additional isolating transformer, with a corresponding first coil of said isolating transformer being connected in series with said resonant circuit.

13. The electrical circuit of claim 1, including means for switching for the selection of a predetermined lamp current.

14. The electrical circuit of claim 13, wherein said means for switching influences the rated value of the lamp current.

15. The electrical circuit of claim 13, wherein said means for switching influences the actual value of the lamp current.

* * * * *